United States Patent [19]

Hall et al.

[11] Patent Number: 4,835,989

[45] Date of Patent: Jun. 6, 1989

[54] MACHINE KNITTED FABRICS

[76] Inventors: John H. Hall, Main South Road, Katikati; Robert N. Watson, Flat 5, 73 Wintere Road, Papatoetoe, Auckland, both of New Zealand

[21] Appl. No.: 215,587

[22] Filed: Jul. 5, 1988

[30] Foreign Application Priority Data

Jul. 9, 1987 [NZ] New Zealand ..... 221022
Feb. 26, 1988 [NZ] New Zealand ..... 223675

[51] Int. Cl.[4] ..... D04B 23/00
[52] U.S. Cl. ..... 66/203; 66/192; 66/214; 66/207
[58] Field of Search ..... 66/204, 205, 203, 207, 66/190, 192, 193

[56] References Cited

FOREIGN PATENT DOCUMENTS 2151743 4/1972 Fed. Rep. of Germany ..... 66/193

*Primary Examiner*—Ronald Feldbaum
*Attorney, Agent, or Firm*—Young & Thompson

[57] ABSTRACT

A method and apparatus is disclosed for laying a drawthread into a machine knitted fabric. Before it is laid the drawthread is carried from between one side and another of the yarns which are being knitted to form the fabric by a component which passes between yarn guides of the machine. The component may be permanently located between the yarn guides or may pass between the yarn guides and out again between two stitch forming cycles of the machine. On both sides the drawthread is positioned by the said component clear of the area where stitches are formed so that it is not knitted into the fabric.

12 Claims, 6 Drawing Sheets

MACHINE KNITTED FABRICS

FIELD OF THE INVENTION

This invention relates to netting and other fabric manufactured by machine knitting processes. Although the invention will be discussed herein with particular reference to netting the invention is applicable in principle to any knitted fabric.

BACKGROUND OF THE INVENTION

Nowadays netting is used for a wide variety of purposes in many industrial, horticultural and agricultural fields. For example, netting finds application as windshelter in orchards. One of the easiest ways to erect netting is to suspend if from lengths of wire fixed to the edges of the netting, the wire being mounted on poles or other supports. The wire can be tied to the netting but it is generally easier to thread the wire through holes in the edge of the netting. For this purpose such holes, at least in knitted netting, are often preformed in the edge and further the selvedge is often specially formed and reinforced so as to be strong enough to cope with the stresses applied thereto in use. In knitted netting the forming and reinforcing of the selvedge can be a relatively easy matter, requiring in the simplest case merely an increase in the density of the stitching or an increase in the gauge or denier of the yarn. The threading of wire through the edge of netting, which is carried out by the end user, is time consuming and laborious. It is an object of the invention to alleviate this problem or at least to offer the public a netting with a feature which, as far as the applicant is aware, has not up to now been available.

SUMMARY OF THE INVENTION

According to the invention there is provided a method of laying a drawthread into a fabric knitted on a machine provided with one or more yarn guides for guiding one or more yarns to be knitted into the fabric at a stich-forming station, including the steps of causing an unlaid portion of the drawthread extending from a position at which it joins the fabric to be located in a first disposition on one side of said one or more yarns during a first predetermined number of stitch-forming cycles of the machine and causing the unlaid portion of the drawthread to be located in a second disposition in which during a second predetermined number of stitch-forming cycles of the machine the unlaid portion of the drawthread passes from the position at which it joins the fabric to a position on an opposite side of said one or more yarns and from the latter position clear of the stitch-forming station back to the one side.

Further according to the invention there is provided apparatus for laying a drawthread into a fabric knitted on a machine provided with one or more yarn guides for guiding one or more yarns to be knitted into the fabric at a stitch-forming station including actuating means for causing an unlaid portion of the drawthread extending from a position at which it joins the fabric to be located in a first disposition on one side of said one or more yarns during a first predetermined number of stitch-forming cycles of the machine and for causing the unlaid portion of the drawthread to be located in a second disposition in which during a second predetermined number of stitch-forming cycles of the machine the unlaid portion of the drawthread passes from the position at which it joins the fabric to a position on an opposite side of said one or more yarns and from the latter position clear of the stitch-forming station back to the one side.

Further aspects of the invention will appear from the claims.

The drawthread may be comprised of any material suitable to be laid into the fabric by the machine. For the purpose of this specification the characteristic of a drawthread is that it is not secured to any part of the fabric so that if desired it may be drawn out of the fabric by being pulled from one end. The utility of the drawthread in a windshelter net is that one end of the drawthread may be attached to the end of a wire and the wire drawn onto the net by means of pulling the drawthread. The term is intended to be applied to any suitable elongate element such as a yarn or line which can be handled by a machine and furthermore is not limited to such an element which is intended to be drawn out of the fabric. The element may for example be laid into the fabric purely for decorative purposes.

BRIEF DESCRIPTION OF THE DRAWINGS

The invention is further discussed with reference to the accompanying drawings in which embodiments of the invention are disclosed by way of example only and in which.

DETAILED DESCRIPTION OF THE EMBODIMENTS OF THE INVENTION

Figure 1:
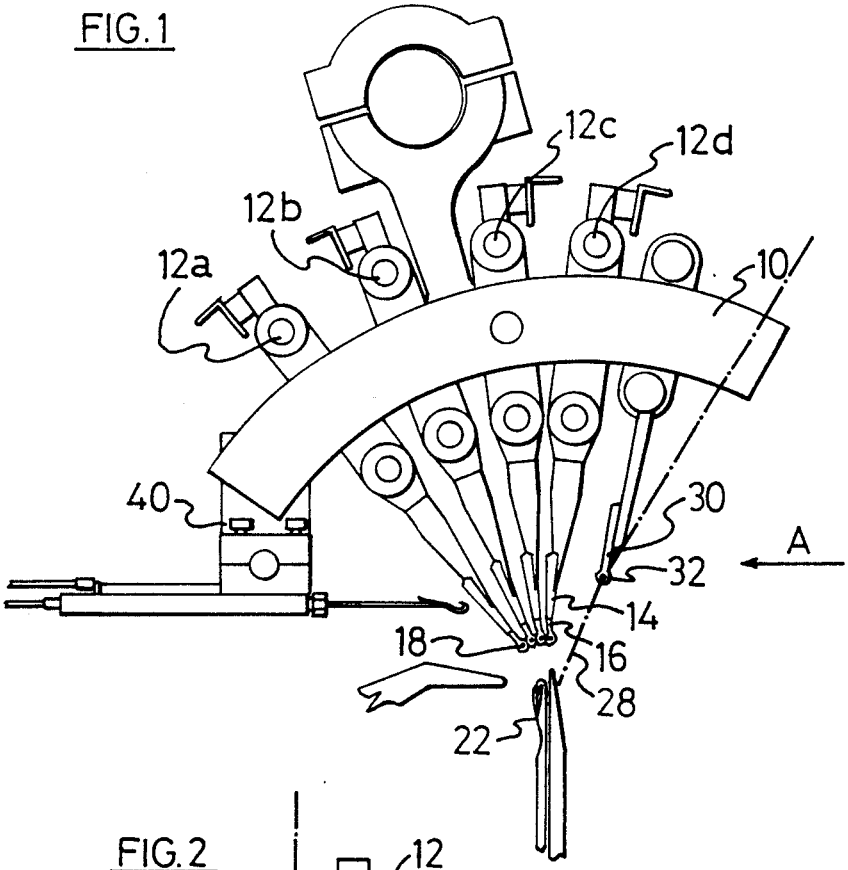
FIG. 1 is a somewhat schematic view in the longitudinal direction of the stitch-forming zone of a Raschel knitting machine.
Figure 2:
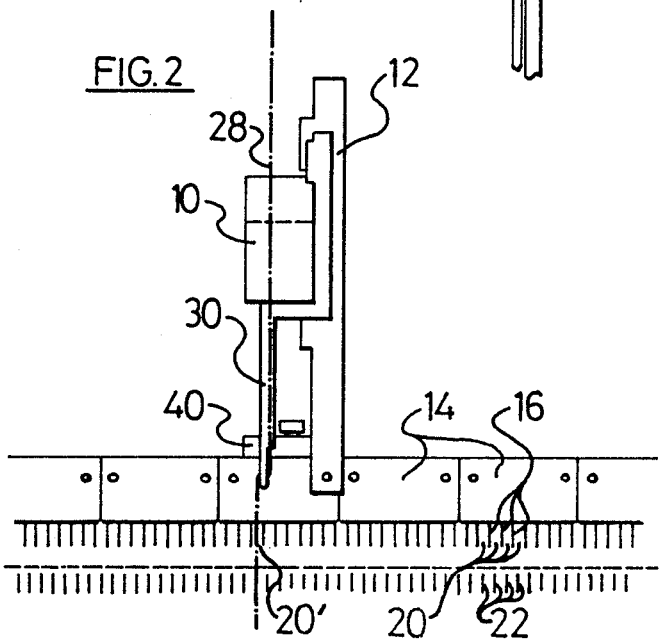
FIG. 2 is a similarly schematic view in the lateral direction (i.e. in the direction of arrow A of the stitch-forming zone.
Figure 3:
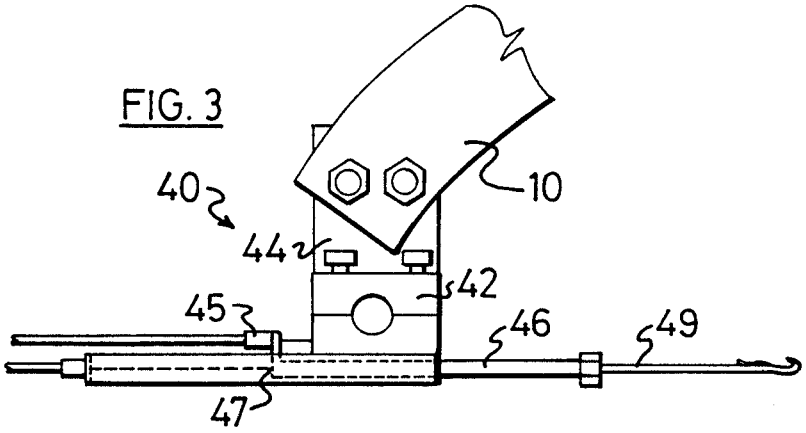
FIG. 3 is a detailed side view of a mechanism for carrying a carrier needle.
Figure 4:
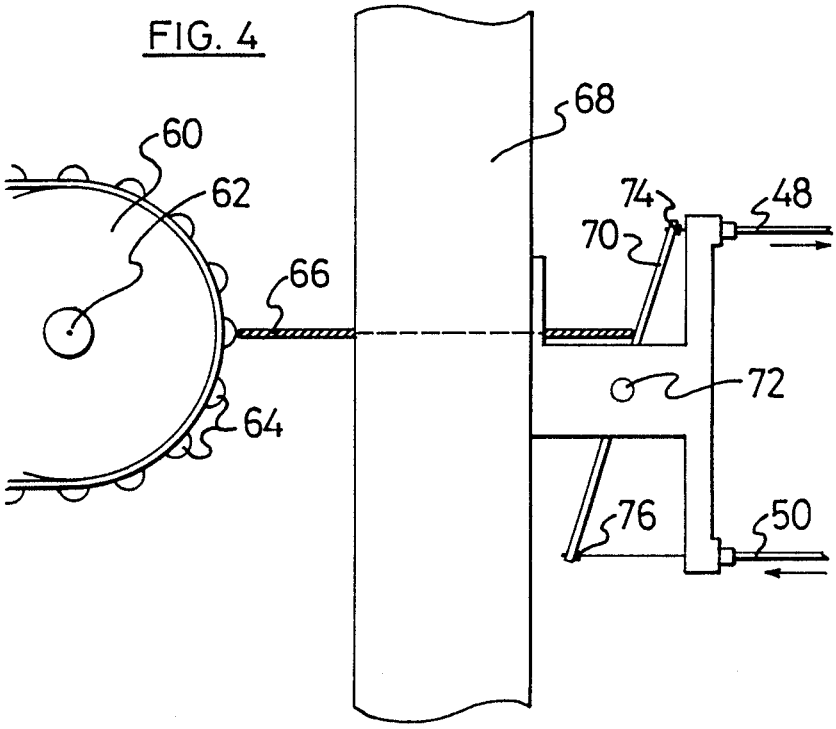
FIG. 4 is a view, again somewhat schematic, in the lateral direction of a system for actuating the mechanism shown in FIG. 3.

To assist in an understanding of the invention it will be convenient first to describe certain components of a Raschel knitting machine and the function thereof. Referring first to FIGS. 1 and 2 the stitch-forming components of a Raschel knitting machine comprise a number of swing arms 10, only one of which is shown. A number of guide bars 12*a*, 12*b*, etc are mounted on the swing arm, four guide bars being shown in the present instance. The swing arms are disposed in the lateral direction, i.e. transversely to the lengthwise aspect of the machine and parallel to the direction in which the fabric being knitted emerges from the machine. Each guide bar is disposed in the longitudinal direction, i.e. parallel to the lengthwise aspect of the machine and transversely to the direction in which the fabric being knitted emerges from the machine. Each guide bar carries a series of guide blocks 14 which in turn each carry a series of yarn guides 16. The effect of the construction described is that there are a number (in the present case four) of mutually parallel straight rows each comprising some hundreds of guides 16 extending in the longitudinal direction of the machine. Individual filaments are led from reels at the top of the machine downwardly through eyes 18 in either all or selected ones of the guides 16, depending on the nature of the net or other fabric to be knitted.

Mechanism is provided for rocking the swing arms 10 in unison in the lateral direction during each stitch-forming cycle of the machine. Furthermore, mechanism is provided for causing each row of guides 16 to be moved independently of the other rows in the longitudinal direction during each stitch-forming cyle. These motions are of course synchronised. However at the beginning of a cycle each guide in a row is in alignment in the transverse direction with one guide in each other row. Since all of the guides are spaced a constant distance apart in the longitudinal direction there is at the beginning of the cycle a clear space 20 between each set of transversely aligned guides and the adjacent such set. During the stitch-forming cycle a vertically disposed hooked needle 22 is moved upwardly from its position of repose below the guides and then in the transverse direction through the space 20. In this movement the needle 22 hooks onto the said filaments which pass through the eyes 18 in the guides and down into the fabric being formed. The needle is then moved downwardly and the so-hooked filaments are consequently drawn downwardly through a stitch which was formed on the needle during the previous cycle and which is now cast off from the needle.

All of the mechanism described thus far with reference to the drawings, and the operation thereof, is known and well understood by those skilled in the art and it is not considered necessary to describe it or the rest of the machine in further detail.

A drawthread 28 shown in chain dotted line is paid off a suitable reel (not shown) at the top of the machine and led by conventional means to a guide 30 mounted on the swing arm 10 at one side of the guide bars 12. In the present case the guide 30 is mounted on the side to which the technical face of the fabric faces. The guide 30 may be substantially identical to the guides 16, having an eye 32 through which the unlaid drawthread passes, but it will be understood that (at least in the case of the shelter netting visualised herein) there will usually only be one or only a limited number of drawthreads in any fabric being knitted and thus only a single guide 30 need be provided for each drawthread. The guide 30 holds the drawthread in a vertical plane disposed in the transverse direction and passing through a selected one of the spaces 20. This selected space will be called for convenience the space 20' and (where the fabric is a net) is advantageously that space between those sets of stitch-forming guides 16 which form knitted eyes at intervals in the selvedge of the net.

A carrier assembly 40 is mounted on the swing arm 10 at the end thereof opposite that at which the guide 30 is mounted, i.e. on the side to which the technical back of the fabric faces. The carrier assembly 40 comprises a split block 42 mountable on a bar 44 attached to the swingarm 10. A quill 46 is mounted for sliding movement in a cylindrical passage in the lower portion of the block 42. The axis of the passage lies in the said vertical plane through the space 20' aligned with the guide 30. A needle which will be called a carrier needle 49 to distinguish it from the stitch forming needles 22 is mounted on one end of the quill, the axis of the carrier needle being aligned with the guide 30. The carrier needle is dimensioned so as to be capable of passing through the space 20' clearing the guides 16 on both sides. The quill is provided at its opposite end with two sockets 45, 47 in which the ends of flexible wire cables 48,50 are anchored. The one cable 48 is arranged to push the quill and the other cable 50 is arranged to pull the quill in the first case so that the carrier needle 49 passes into and through the space 20' and in the second case so that the carrier needle 49 is withdrawn from the space 20'. The withdrawal of the carrier needle may be assisted by a return spring, not shown in the present case.

The cables are actuated by a pattern drum 60 mounted on the axle 62 carrying the lower sprocket wheel on which the pattern chain of the machine is mounted. Cams 64 are mounted on the periphery of the drum 60 and drive a cam-following pushrod 66 mounted for movement along its axis in a housing on the frame 68 of the machine. Also mounted on the frame 68 of the machine is an assembly comprising a rocker plate 70 which pivots about a horizontally disposed axle 72. The end of the quill pushing cable 48 is anchored to a socket 74 at the top of the rocker plate and the end of the quill pulling cable 50 is anchored to a socket 76 at the bottom of the rocker plate. The pushrod 66 bears on the back face of the rocker plate at a position closer to the axle 72 than the sockets 74, 76. The axial displacement of the cables 48, 50 is by this means greater than the axial displacement of the pushrod. The pushrod is urged into contact with the face of the pattern drum by means of return springs, not shown.

It should be understood that, in the example here described, there will be a pair of push- and pull cables for each drawthread to be laid into the net. All of the cables may however be actuated by a single rocker plate.

In operation the machine commences to knit a fabric in conventional manner. It is however necessary that the end of the drawthread be tied or otherwise fixed to the leading edge of the fabric after being passed through the eye 32 in the guide 30. It will be understood that the unlaid portion of the drawthread is disposed in a substantially straight line between the point at which it is attached to the leading edge of the fabric and the eye 32 of the guide 30 and is thus not knitted into the fabric. Knitting is continued until a first eye 80 in the net 82 starts to be formed. At a predetermined point during the forming of the eye 80 and between two stitch-forming cycles of the machine a cam on the periphery of the pattern drum actuates the quill pushing cable 48 to cause the carrier needle 49 to pass through the space 20' and hook the part of the drawthread between the just-formed fabric and the guide 30. The quill pulling cable 50 is immediately thereafter actuated to cause the carrier needle to be withdrawn from the space 20' drawing with it the said part of the drawthread. At the end of this operation the unlaid part of the drawthread extends upwardly from the upper edge of the just-formed fabric around the hook of the carrier needle 49 (which is located on the side of the technical face of the fabric) and back though the space 20' to pass clear above the stitch-forming station through the eye 32 of the guide 30. The phase of operation of the machine with the drawthread in this latterly described disposition will be called for convenience the "intermediate phase" of operation.

It is important that during the intermediate phase the hook of the carrie needle 49 and the eye 32 are so relatively located that the portion of drawthread disposed therebetween is located above the path which will be taken by the stitch-forming needle or needles 22 which pass through the space 20' in subsequent stitch-forming operations while the drawthread is so disposed. Also, of course it is important that in the intermediate phase the drawthread is positioned so that it does not become hooked by any stitch-forming needle 22. In this manner the drawthread does not become attached (knitted into) to the fabric during the intermediate phase.

At the end of the intermediate phase, i.e. after a number of stitch-forming cycles of the machine determined by the desired spacing of the eyes through which the drawthread is laced, the carrier needle 49 releases the unlaid portion of the drawthread. Under its own tension the drawthread then moves across and out of the space 20' and, until it is again hooked by the carrier needle 49 at the commencement of the following intermediate phase remains on the opposite side of the fabric.

It will be clear to those skilled in the art that the carrier needle may be actuated by various alternative means including, as stated above, pneumatic, hydraulic and electromagnetic means. Also, the carrier needle need not necessarily be provided with a hook to the drawthread through the space 20' but may be provided with any suitable means such as a pincer mechanism for this operation. Indeed the carrier means may not comprise a needle at all but may instead comprise or consist of any suitable device capable of moving the unlaid part of the drawthread through the space 20' and releasing it at the requisite times.

Figure 5:
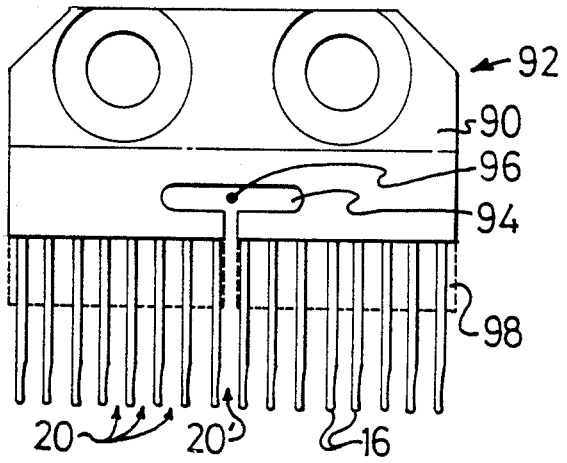
FIGS. 5 to 7 are three detailed views of guide blocks modified in accordance with alternative aspects of the invention.

An alternative means of achieving the same result would include a carrier such as a needle having an eye in which the drawthread is permanently located. In this case the carrier needle would have to remain in the space 20' during the intermediate phase of operation of the machine. To allow for the fact that the carrier needle is rigid any of the guide blocks shown in FIGS. 5 to 7 may be provided. In FIG. 5, the body 90 of the guide block 92 has a T-shaped slot 94 formed therein and opening to the lower edge of the body 90. The length of the slot 94 to either side of the position (indicated at 96) in the slot at which the carrier needle enters the slot must be at least as great as the distance through which the guides are moved from that position in the longitudinal direction towards both ends of the machine during the stitch-forming cycles. In this way the guide blocks can operate during the intermediate phase without coming into contact with and fouling the carrier needle. To compensate for the diminished strength of the body as a result of the existence of the slot, the depth of the body can if necessary by increased as indicated by the dotted line 98. This increase in depth will also enable the mounting of the guides on the body to be strengthened.

Figure 6:
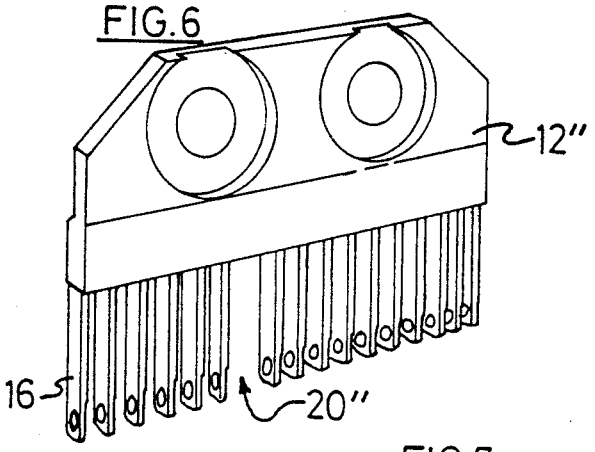
Figure 7:
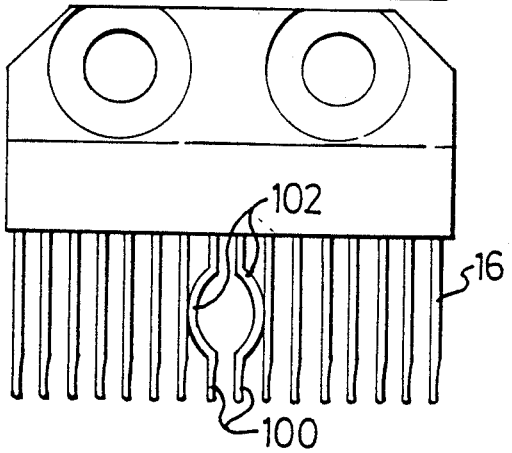

It nets and other fabrics knitted according to some patterns not all of the guides 14 in a guide block are required. In FIG. 6 a guide block 12'' is shown from which an unneeded guide has been removed. The carrier needle can be accommodated in the much wider space 20'' between the guides 14 on either side of the guide which was removed. In FIG. 7 two of the guides 100 of a guide block are shown as being joggled in opposite directions at 102. The carrier needle can be accommodated in the space between the joggles.

Figure 9:
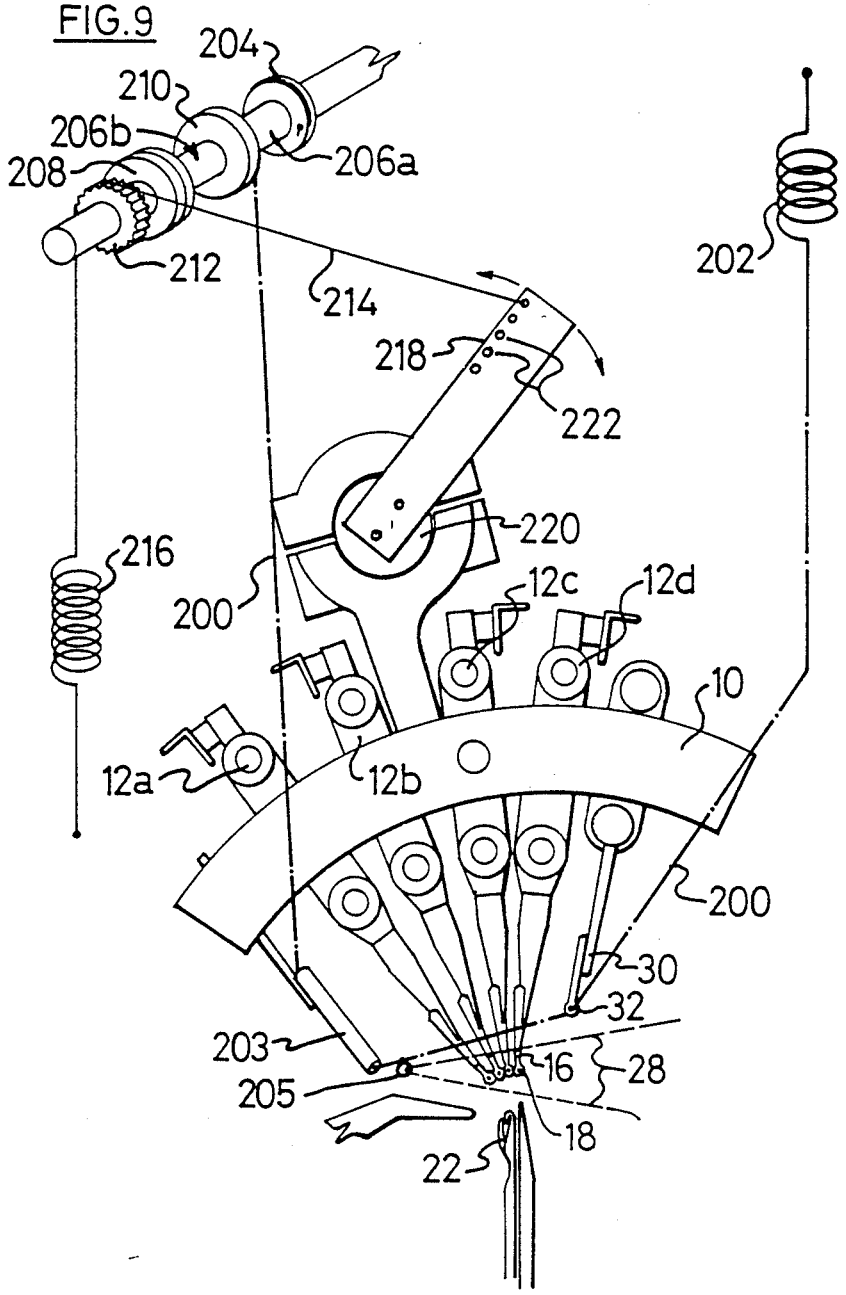
FIG. 9 is a somewhat schematic layout of an alternative exemplary arrangement for moving a drawthread between two positions one on either side of a stitch-forming zone.

Those skilled in the art will recognise that the arrangement shown in FIG. 9 is similar to that shown in FIG. 1. In the following description those components which are allocated the same reference numerals will not be further described herein as they are identical to, and function in the same manner as, the components described in the parent application.

In FIG. 9 a fine flexible element 200 which is shown diagramatically as a chain dotted line but in reality takes the form of a steel wire or cable having a diameter of the same order as that of a guitar string is permanently disposed above but clear of the stitch-forming zone. The wire 200 is anchored at one end through a tension spring 202 to a suitable location on the frame of the machine. It passes through the eye 32 in the guide 30 mounted on the swing arm 10 and above the stitch-forming zone between pairs of yarn guides 16 mounted on guide blocks 14. It then passes into a guide tube or sheath 203 and around the periphery of a drum 204 to which it is anchored. A ring 205 is fixed to the wire 200 in a position close to where the wire passes over the stitch-forming zone. As will be explained in the operation of the arrangement the wire is caused to move back and forth and the ring 205 is positioned on the wire so that it is carried over the stitch forming zone between the yarn guides each time that the wire is so moved. The drawthread 28 passes through the ring and is thus, in the same way as indicated with reference to FIG. 1, moved periodically from one side of the stitch-forming zone to the other.

The drum 204 is fixed on a shaft 206 which is rotatably mounted by means of bearings (not shown) on the frame of the machine. The shaft 206 is longitudinally split, the two parts being arranged to be coupled by means of an electronically actuated clutch assembly 208. The part **206*a* of the shaft carrying the drum 204 is provided with a brake assembly 210, also electronically operated. A sprocket wheel 212 is fixed on the other part 206*b* of the shaft. A sprocket chain 214 engages the sprocket wheel. One end of the chain 214 is anchored through a tension spring 216 to a suitable location on the frame of the machine. The other end of the chain is anchored on a lever 218 which is fixed on the shaft 220 which rocks the swing arms 10 so that the lever rocks in unison with the swing arms. The lever 218 thus causes the chain 214 to reciprocate, thereby driving the sprocket wheel first in one sense and then in the opposite sense in unison with the swing arms. The distance through which the chain moves and hence the angular distance through which the sprocket wheel 212 is rotated may be adjusted by fixing the said other end of the chain in any one of the holes 222** spaced along the lever.

It will be understood that the sprocket wheel 212 rotates back and forth continuously in unison with each stitch-forming cycle of the machine. The drum 204 on the other hand is rotated only when the clutch assembly couples the two parts of the shaft together.

Figure 10:
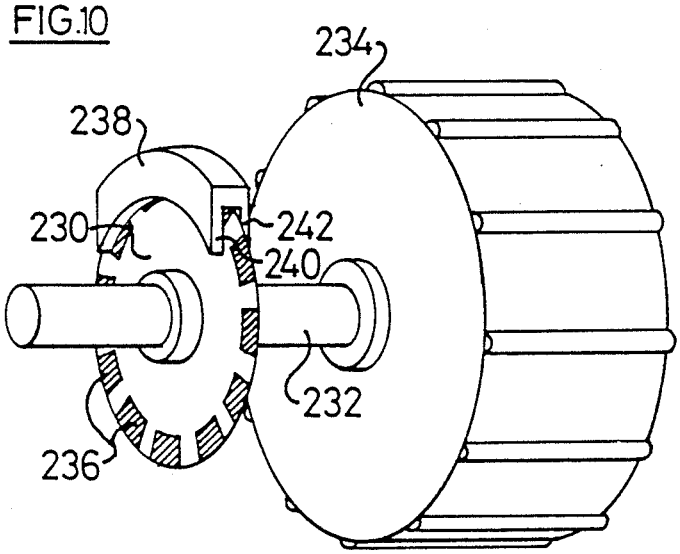
FIG. 10 is a perspective view, also somewhat schematic, of an assembly for actuating the arrangement shown in FIG. 9.

Referring to FIG. 10, a clear disc 230 is mounted on the shaft 232 which carries the pattern drum 234 of the machine. Spaced zones 236 of the periphery of the disc 230 are rendered opaque by blackening the zones in any suitable manner. A capliper shaped "seeing eye" device 238 is located over the periphery of the disc with its arms 240 and 242 disposed one on either side of the disc.

The device directs a light beam from one arm 240 to the other 242 through the disc. Thus the light beam is interrupted periodically as a zone 236 on the disc passes between the arms when the disc rotates. In the present case the disc is arranged so that the light beam is interrupted by a blackened zone during each stitch-forming cycle of the machine. Commercially available electronic circuitry (not shown) is provided which senses and counts the interruptions of the light beam and in response thereto after a predetermined number of stitch-forming cycles causes the brake assembly 210 to be released to allow the part 206*a* of the axle to rotate and also causes the clutch assembly 208 to couple the two parts of the shaft 206 together thus causing the sprocket wheel to drive the drum 204 through the shaft.

The circuitry causes the clutch assembly to decouple and the brake assembly to be reapplied after a single reciprocation of the chain 214. The drum 204 is thus rotated once in one direction. Thereafter the machine goes through a further predetermined of number of stitch-forming cycles after which the clutch and brake assemblies are again actuated to cause the drum to be rotated once in the opposite sense.

Figure 8:
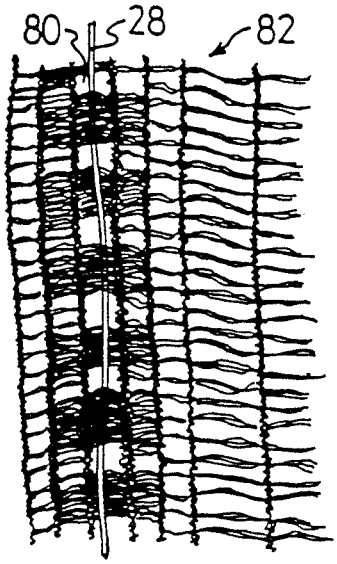
FIG. 8 is an illustration of a portion of a net knitted with an inlaid drawthread in accordance with the invention.

The periodic rotation of the drum causes the ring 205 and hence the drawthread to be drawn from one side of the stitch-forming zone to the other between intervals during which the machine continues to form stitches. By this means a net with a drawthread as shown in FIG. 8 is knitted.

A desired number of pulleys 204 may be mounted on the shaft 206 and coupled or decoupled thereto at predetermined intervals by means of suitable clutches. A corresponding number of drawthread may thus be laid into the fabric for functional, decorative or any other purpose.

Figure 11:
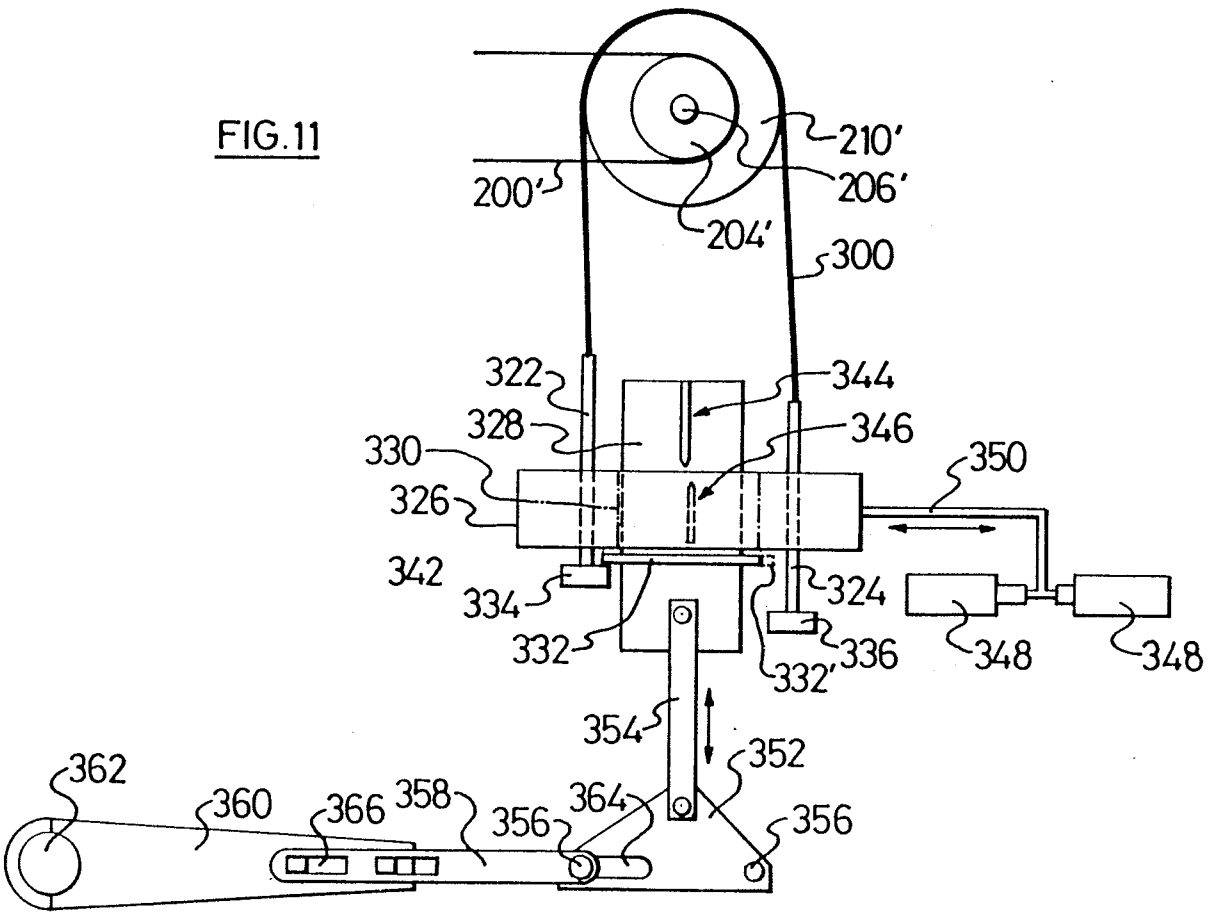
FIG. 11 is a view, again somewhat schematic, of yet another arrangement for moving a drawthread between two positions one on either side of a stitch-forming zone.

An alternative construction is shown in FIG. 11. In the following description certain components are identified by a dashed (') numeral in order to indicate that they serve essentially the same function as the components identified by the similarly numbered undashed components shown in FIG. 9. The split shaft 206 of the mechanism shown in FIG. 9 is replaced in the mechanism shown in FIG. 11 by a solid shaft 206'. The clutch 208 and sprocket wheel 212 are dispensed with. A cable 300 is passed around and anchored on a pulley 210' mounted on the shaft 206'. The ends of the cable 300 are connected to shafts 322, 324. The shafts 322, 324 are mounted for vertical sliding movement in what will be called a cross slide 326 which is in turn mounted for horizontal sliding movement in guides formed in a bracket (not shown) bolted or otherwise fixed to the frame or other suitable component of the knitting machine. The cross slide 236 is provided with a vertical slot indicated by dotted lines 330. What will be called a vertical slide 328 is accommodated in the vertical slot. The vertical slide is also mounted for vertical sliding movement in guides in the aforementioned bracket. The width of the slot 330 is somewhat greater than the width of the vertical slide to allow for horizontal movement of the vertical slide within the slot with respect to the cross slide. What will be called a catch plate 332 is mounted on the vertical slide below the cross slide.

The shafts 322, 324 are provided with heads or what will be called pull blocks 334, 336. A wire or cable 200' is passed around a pulley or drum 204' mounted on the shaft 206'. The wire 200' functions in the same way as the wire 200 shown in FIG. 9 except that the spring 202 is not used. Instead both ends of the wire 200' are attached to the pulley 204', one on either side thereof. Thus, as should be clear, downward movement of, say, the one pull block 334 will cause the wire 200' to be drawn in one direction and downward movement of the other pull block 336 will cause the cable 200' to be drawn in the opposite direction.

The length of the cable 300 is arranged so that when one pull block has been drawn downwardly by the catch plate during the vertical oscillation of the vertical slide as will be described there is a clearance at least equal to the thickness of the catch plate 332 between the other pull block and the bottom face 342 of the cross slide. The shafts 322, 324 are positioned so that when the vertical slide is at the top of its vertical travel and the cross slide is moved (as will be described) to either limit of its horizontal travel in the slot 330 with respect to the vertical slide, the edge of the catch plate can move into the clearance between one or other of the pull blocks and the bottom face 342 of the cross slide. In the drawing the dotted line 332' indicates the position of the catch plate when it has has moved into the clearance between the pull block 334 and the face 342. Thus when the vertical slide commences to move downwardly in the course of its vertical oscillation the catch plate will draw the pull block 334 downwardly. The pull block will in turn draw the wire 200' with it and thus change the position of the eye (corresponding to the eye 205 in FIG. 9) from one side of the work station to the other.

Any desired number of pulleys 204' each carrying a wire 200' can be mounted on the shaft 206'. This will enable a corresponding number of drawthreads to be laid into the fabric.

The near face of the vertical slide is provided at the centre of its upper end with a vertically disposed selector lock plate 344 the lower end of which is formed as a knife edge. Similarly a vertically disposed selector guide plate 346 is provided at the centre of the cross slide, accommodated in the slot 330. The upper end of the selector guide plate is also formed as a knife edge. The width of the slot 330 is such that the vertical slide can oscillate with the selector lock plate 344 located on either side of the selector guide plate 346. The lock plate 344 and guide plate 346 are provided to ensure that once the vertical guide is moved to one end of the slot 330 or the other it will stay there during a vertical oscillation of the vertical guide in the slot. The vertical guide can be moved to the other end of the slot only when the vertical guide is close to its upper limit of travel and the lock plate 344 has moved clear of the guide plate 346. The knife edges are provided to reduce the possibility of the lower edge of the lock plate fouling the upper edge of the guide plate when the vertical guide commences its downward travel in the slot.

The horizontal movement of the cross slide is achieved by a pair of solenoids 348 linked to the cross slide by a linkage 350. The solenoids are actuated by current from a suitable circuit not shown in response to signals generated by the apparatus already described with respect to FIG. 10. The solenoids are conveniently mounted on the aforementioned bracket, not shown.

The vertical oscillation of the vertical slide is achieved by linking its lower end to one arm of a crank plate 352 by a link 354. The crank plate 354 is also mounted on the aforementioned bracket and pivots about a pivot 356. The other arm of the crank plate is linked by means of a connecting arm 358 to a lever 360 mounted on an oscillating shaft 362 which is part of the knitting machine. The connection between the crank plate and the connecting arm is made providing a slot 364 in the said other arm of the crank plate. A ball bearing 366 mounted on the end of the connecting arm 358 is located in this slot 364. Thus rotary oscillation of the lever 360 causes corresponding rotary oscillation of the crank plate 354 and this in turn causes vertical oscillation of the vertical slide. To accommodate variations in the throw of the lever 360 due to variations in the oscillation of the shaft 362 the connecting arm is provided with slots 366 through which it is bolted to the lever 360. The throw of the connecting arm can thus be varied.

In the arrangement shown in FIG. 11 the vertical slide oscillates continuously but the cable 300 and hence the wire 200 is moved in one direction or the other only at selected intervals.

It is not intended that the scope of a patent granted in pursuance of the application of which this specification forms a part should exclude modifications and/or improvements to the embodiments described and/or illustrated which are within the spirit of the invention as defined in the claims or be limited by details of such embodiments further than is necessary to distinguish the invention from the prior art.

We claim:

1. A method of laying a drawthread into a fabric knitted on a machine provided with one or more yarn guides for guiding one or more yarns to be knitted into the fabric at a switch-forming station, including the steps of causing an unlaid portion of the drawthread extending from a position at which it joins the fabric to be located in a first disposition on one side of said one or more yarns during a first predetermined number of stitch-forming cycles of the machine and causing the unlaid portion of the drawthread to be located in a second disposition in which during a second predetermined number of stitch-forming cycles of the machine the unlaid portion of the drawthread passes from the position at which it joins the fabric to a position on an opposite side of said one or more yarns and from the latter position clear of the stitch-forming station back to the one side.

2. A method according to claim 1, in which the unlaid portion of the drawthread is moved from the first disposition to the second disposition between a first two stitch-forming cycles and from the second disposition to the first disposition between a second two stitch-forming cycles.

3. Apparatus for laying a drawthread into a fabric knitting on a machine provided with one or more yarn guides for guiding one or more yarns to be knitted into the fabric at a stitch-forming station, the apparatus comprising (a) a drawthread guide for locating an unlaid portion of said drawthread during a first predetermined number of stitch-forming cycles of the machine on one side of said one or more yarns in a first disposition in which said unlaid portion extends between said drawthread guide and a position at which it joins the fabric;

(b) a carrier 49 needle for engaging said unlaid portion; and (c) actuation means for causing said carrier needle to move said unlaid portion from said first disposition to a second disposition in which, during a second predetermined number of stitch-forming cycles of the machine said unlaid portion extends from the position at which it joins the fabric to a position on an opposite side of said one or more yarns and from the latter position clear of the stitch-forming station back to the one side.

4. Apparatus according to claim 3, in which the actuation means is arranged to move the carrier between two stitch-forming cycles in and out of a space which during at least one stitch-forming cycle is traversed by said one or more yarn guides and, when the carrier is in the said space to cause the carrier to engage the unlaid portion of the drawthread and to carry it through the said space to the second disposition as the carrier is moved out of the space.

5. Apparatus according to claim 3, in which during at least one stitch-forming cycle said one or more yarn guides traversed said stitch-forming station, said actuation means causing said carrier to remain in a disposition in which during said at least one stitch-forming cycle said carrier crosses said stitch-forming station, said one or more yarn guides being shaped so that as they traverse said stitch-forming station during said stitch-forming cycle they do not come into contact with the carrier.

6. Apparatus according to claim 3, in which during at least one stitch-forming cycle said one or more yarn guides traverse said stitch-forming station and said carrier remains in a disposition in which it projects across said stitch-forming station from the one side to the opposite site side of said one or more yarns, said carrier being arranged to flex when it is contacted by said one or more yarn guides during said at least one stitch-forming cycle.

7. Apparatus according to claim 3, in which the actuation means includes connection means for connecting the carrier to a component of the machine which undergoes reciprocating motion in use, the carrier being thereby caused to undergo reciprocating motion between the one side and the opposite side of said one or more yarns.

8. Apparatus according to claim 7, including timing means arranged at intervals to disconnect the carrier from the said component so that said reciprocating motion applied to the carrier is interrupted periodically for a predetermined number of stitch-forming cycles of the machine.

9. Apparatus according to claim 6, in which the carrier comprises a flexible element which remains in the said disposition in which it projects from the one side to the opposite side of said one or more yarns during said first and said second predetermined number of stitch-forming cycles.

10. Apparatus according to claim 9, in which the flexible element is provided with an eye in which the unlaid portion of the drawthread is held captive and which carries the unlaid portion of the drawthread between the first and second dispositions.

11. Apparatus according to claim 7, in which the connection means includes a rotary member, linkage means to link the rotary member to said component to cause the rotary member to undergo reciprocating rotary motion, and an elongate flexible member which can be coupled to the carrier and wound around the rotary member so that, during the reciprocating rotary motion of the rotary member, the elongate flexible member can be fed on and off the rotary member in an axial direction of the flexible member thereby to apply substantially linear reciprocating motion to the carrier.

12. Apparatus according to claim 11, in which the rotary member includes a wheel with a toothed periphery and the linkage means comprises a complementally toothed member arranged to engage the toothed periphery of the wheel and to be coupled to the said component so that substantially linear reciprocating motion applied by the said component to the complementally toothed member causes the wheel to undergo said reciprocating rotary motion.

* * * * *